US005167355A

United States Patent [19]

Hill

[11] Patent Number: 5,167,355

[45] Date of Patent: Dec. 1, 1992

[54] FAST DRAW HOLSTER

[76] Inventor: Ernie H. Hill, 4802 Hidden Ter., Litchfield Park, Ariz. 85340

[21] Appl. No.: 723,756

[22] Filed: Jul. 1, 1991

Related U.S. Application Data

[63] Continuation of Ser. No. 463,508, Jan. 11, 1990, abandoned.

[51] Int. Cl.[5] ..... F41C 33/02

[52] U.S. Cl. ..... 224/193; 224/243; 224/255; 224/911; 403/97

[58] Field of Search ..... 224/192, 193, 196–198, 224/206, 238, 240, 242–248, 252, 253, 255, 269, 911, 912; 403/97, 96

[56] References Cited

U.S. PATENT DOCUMENTS

| | | | |
|---|---|---|---|
| 609,317 | 8/1898 | Zimmerman | 224/193 |
| 926,426 | 6/1909 | Koch | 403/97 X |
| 1,166,781 | 1/1916 | Parrish | 224/255 X |
| 1,334,586 | 3/1920 | Baker | 403/97 X |
| 1,421,578 | 7/1922 | Schussler | 224/243 |
| 1,667,604 | 4/1928 | Peters | 403/97 X |
| 1,768,177 | 6/1930 | Wanee | 224/255 X |
| 2,001,321 | 5/1935 | Berns | 224/193 |
| 2,401,174 | 5/1946 | McAuley | 224/243 |
| 2,555,226 | 5/1951 | Draughn | 403/97 X |
| 2,758,762 | 8/1956 | Medley | 224/243 |
| 2,803,909 | 8/1957 | Soski et al. | 224/911 X |
| 3,261,519 | 7/1966 | Horne | 224/198 |
| 3,315,855 | 4/1967 | Boone | 224/255 |
| 3,353,728 | 11/1967 | Freed | 224/243 |
| 3,718,240 | 2/1973 | Rose | 224/243 |
| 3,828,990 | 8/1974 | Baldocchi | 224/193 |
| 3,915,361 | 10/1975 | Perkins | 224/198 X |
| 3,952,930 | 4/1976 | Baldocchi | 224/193 |
| 4,084,734 | 4/1978 | Bianchi et al. | 224/193 X |
| 4,205,768 | 6/1980 | Hihh et al. | 224/193 |
| 4,273,276 | 6/1981 | Perkins | 224/243 |
| 4,504,001 | 3/1985 | Nichols | 224/198 |
| 4,858,799 | 8/1989 | Young | 224/243 |
| 4,925,075 | 5/1990 | Rogers | 224/244 |

FOREIGN PATENT DOCUMENTS

| | | | |
|---|---|---|---|
| 3027550 | 3/1982 | Fed. Rep. of Germany | 224/196 |

*Primary Examiner*—Henry J. Recla
*Assistant Examiner*—Casey Jacyna
*Attorney, Agent, or Firm*—Cahill, Sutton & Thomas

[57] ABSTRACT

A fast draw holster having an open front supports a handgun with a bore penetrating pin correlated with the caliber and with opposed sides compressively engaging the barrel. A spacer positoned forwardly of the pin prevents intermittent and non uniform pressure contact with the front lower edge of the holster upon withdrawal of the handgun. A ratchet mechanism attaching the holster to a belt supported fender permits the degree of vertical alignment of the holster to be adjusted commensurate with a shooter's preference.

24 Claims, 3 Drawing Sheets

FAST DRAW HOLSTER

This is a continuation application of a co-pending application filed Jan. 11, 1990 and assigned Ser. No. 463,508, entitled "FAST DRAW HOLSTER" now abandoned.

BACKGROUND OF THE INVENTION

1. Field of the Invention

The present invention relates to angularly adjustable fast draw holsters for retaining with a setable constant force a handgun.

2. Description of the Prior Art

Conventional fast draw competitions are for handguns of the revolver type. However, a new category has developed known as "combat" which involves the use of pistols of the clip-fed 0.45 caliber type handguns. In "combat" competitions, a shooter must exhibit competence from each of a plurality of stationary stances and he must be able to draw, aim and fire his handgun while in motion. "Combat" competitions also require that the handgun be lodged within a supporting holster to a degree sufficient to prevent it from falling out were the holster to be turned upside down. This requirement is accomplished either by strapping the handgun into the holster or by having the holster clampingly retain the handgun.

Because of the multitude of positions used in combat competitions, the gun belt and handgun retaining holster must be configured to optimize the draw of the handgun from any one of many stances of the shooter. Necessarily, the requirements of one stance of the shooter are almost mutually exclusive with the requirements imposed by another stance. To develop a holster which optimizes the draw of the handgun at all stances, whether stationary or mobile, is extremely difficult and can be achieved only by a laborious trial and error effort.

During movement from one stance to another, it is mandatory that the handgun be securely retained in the holster for both competition purposes and safety reasons. When a shooter assumes a stance, he must withdraw the handgun rapidly with a smooth movement and bring it up to the aim position with minimal jerking. To achieve these goals, certain characteristics must be embodied within a holster. The holster must retain the handgun sufficiently securely to preclude the handgun from falling out of the holster and even from becoming misaligned within the holster during rapid movements of the shooter. The nature and type of handgun retention mechanism must be adjustable to meet the shooter's preference of withdrawal force required commensurate with retention capability. The retention mechanism must preclude the handgun from rotating about both a longitudinal axis and a lateral axis to ensure that the grip is in the position with respect to the shooter's belt to which he is accustomed and commensurate with a particular stance. Because different shooters have different physiques, it is necessary to provide some adjustment in vertical alignment of the handgun to accommodate relative arm and torso lengths.

Conventional holsters include a simple pocket for retainingly receiving the barrel and chamber of a handgun; sometimes a safety strap extends across a part of the grip or trigger to preclude withdrawal of the handgun. Holsters of this type readily retain a handgun but do not permit rapid withdrawal of the handgun with smoothness. In an effort to develop a holster having adjustable retention capability with fixed repeatable handgun positioning and withdrawal force, the present inventor developed a holster and competition gun belt described in U.S. Pat. No. 4,205,768. This holster has become an industry standard in competitive fast draw events. It accommodates both automatic handguns and pistols.

SUMMARY OF THE INVENTION

To minimize the upward movement on withdrawal of a handgun, a substantial length of the front of a holster remains open. The lower end of the holster supports a pin for penetrably engaging the bore and vertically supporting the handgun. A spacer forwardly thereof extends partly about the muzzle adjacent to the front sight to provide uniform repeatable frictional engagement upon withdrawal. Retention of the handgun is provided by semi rigid opposed sides gripping the barrel to prevent upward sliding movement; the gripping force of these sides is adjustable. The opposed sides, in combination with the pin, prevent pivotal movement of the handgun about the lateral axis and the spacer, engaging a segment of the front sight of the barrel, precludes rotation of the handgun about the axis of the bore. The holster is attached to a belt supported fender by a ratchet mechanism which accommodates adjustment in vertical alignment of the handgun commensurate with a shooter's preference.

It is therefore a primary object of the present invention to provide a fast draw holster.

Another object of the present invention is to provide means for affirmatively vertically aligning the handgun in a holster.

Yet another object of the present invention is to provide a spacer for preventing a variable pressure and friction of a holster from acting upon the muzzle during withdrawal of the handgun.

Still another object of the present invention is to provide compressively gripping opposed sides for engaging the barrel of a handgun.

A further object of the present invention is to provide a fast draw holster having a substantially open front for securely retaining a handgun while accommodating rapid withdrawal of the handgun through the open front.

A yet further object of the present invention is to provide a ratchet mechanism for securing a fast draw holster to a belt supported fender to permit adjustment of the vertical alignment of the holster.

A still further object of the present invention is to provide a method for retaining a handgun in a fast draw holster.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DESCRIPTION OF THE PREFERRED EMBODIMENT

Figure 1:
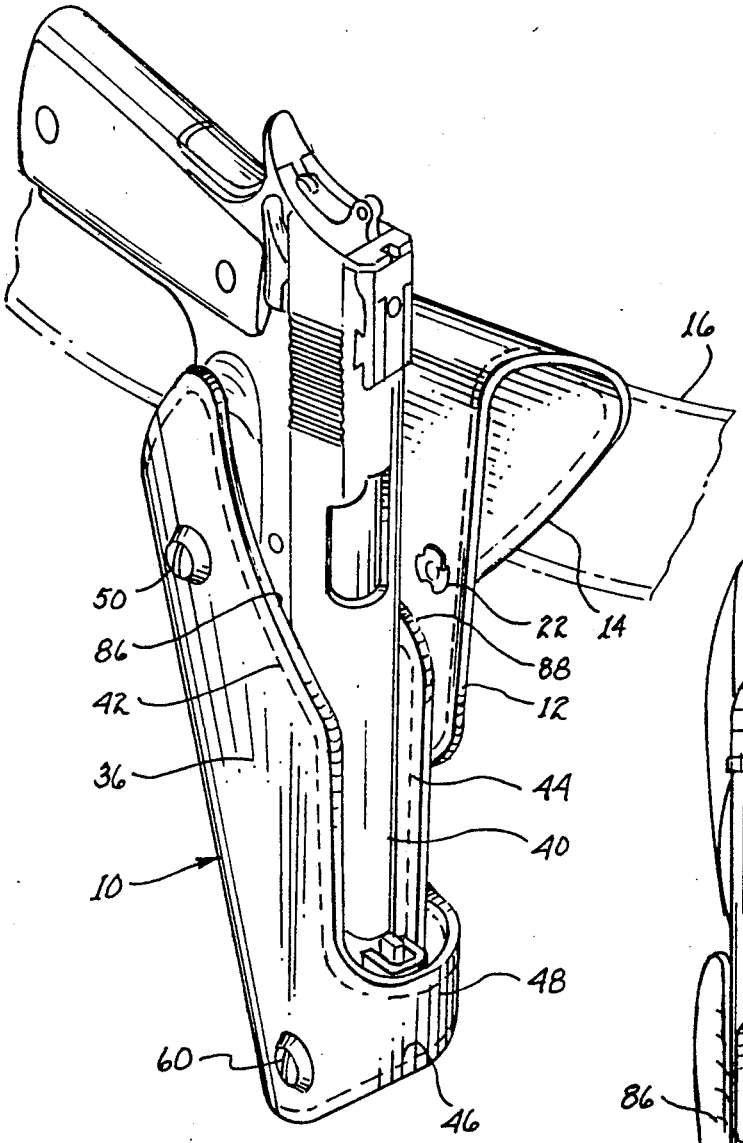
FIG. 1 is a perspective view illustrating a handgun lodged within a fast draw holster.
Figure 2:
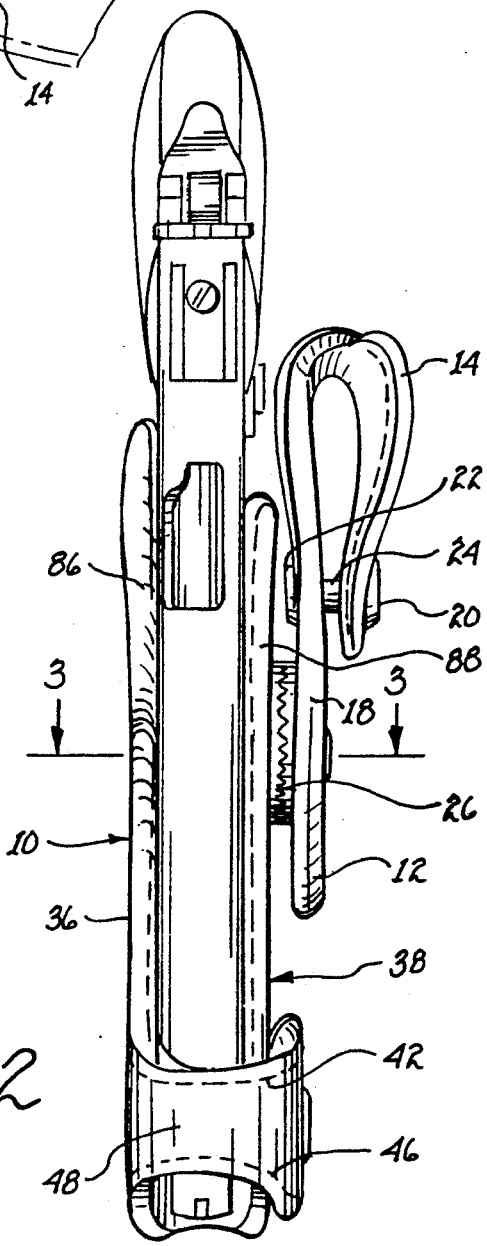
FIG. 2 is a front elevational view of a fast draw holster supporting a handgun.

To accommodate rapid and smooth withdrawal of a handgun from a belt mounted holster, holster 10 illustrated in FIGS. 1 and 2 was developed. The holster is pivotally adjustably attached to a fender 12. The fender includes a loop section 14 which extends about belt 16 worn by a shooter. The loop section is secured to the generally vertically upright rigid body 18 of the fender with machine screws 20 engaging threaded sockets 22. To prevent abrasion of belt 16 by the threaded shanks of screws 20, threaded socket 22 may include a threaded boss 24 extending therefrom; alternatively, a length of tubing may be disposed about each of the threaded shanks of the screws. To maintain fender 12 relatively positionally fixed, it is intended that body 18, in combination with loop section 14, grip belt 16 in a firm manner. Holster 10 is mounted upon fender 12 by means of an adjustable ratchet mechanism 26, as will be described in further detail below.

Figure 3:
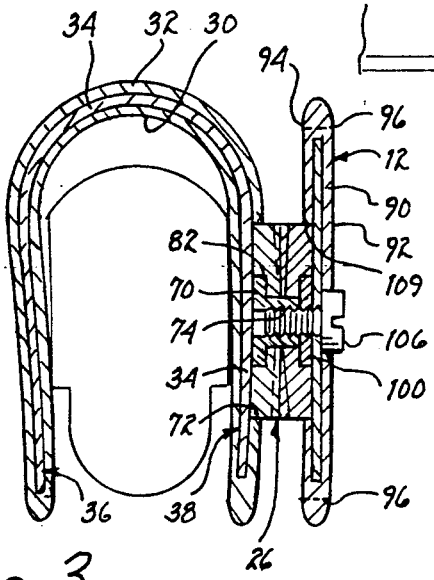
FIG. 3 is a cross sectional view taken along lines 3—3, as shown in FIG. 2.

Referring additionally to FIG. 3, further details attendant holster 10 will be described. The main body of the holster is formed of laminations 30 and 32, which may be of leather, disposed on opposed sides of a longitudinally curved metallic sheet 34. The purpose of the metallic sheet is that of maintaining resiliently rigid but adjustable the width between sides 36 and 38 of holster 10. These sides compressively engage opposed surfaces of the barrel and possibly the chamber section of a handgun 40. The degree of compressive force exerted by the sides is a function of the handgun retentive capability of the holster. It is therefore to be understood that material other than a metallic sheet 34 may be employed if such substitute material is capable of performing the function(s) sought.

The edges of laminations 30,32 may be attached to one another by stitching 42,44,46 alone or in combination with adhesives. The resulting sealing of the edges of the laminations ensures fixed lodgement of metallic sheet 34 between the laminations. The lower end of holster 10 includes a strap 48 extending from side 36 to side 38. This strap is devoid of metallic sheet 34 to permit intermittent engagement and disengagement of the strap end with side 38. Stability of the cross section of the upper end of holster 10 is augmented by a machine screw 50 extending from side 36 into threaded engagement with a threaded socket 52 fixed to side 38 (see FIG. 5). A spacer 54 is mounted upon threaded shank 56 of machine screw 50 between the interior surfaces of sides 36,38. This spacer also serves as support for the trigger guard of handgun 40 on placement of the handgun within the holster. A washer 58 may be employed to support the head of machine screw 50 A muzzle engaging pin and muzzle guiding spacer is secured at the lower end of holster 10 by a machine screw 60 and an accompanying threaded socket 62 (see FIG. 4) to prevent damage to side 36 of holster 10, a washer 64 may be disposed to receive the head of the machine screw.

Figure 4:
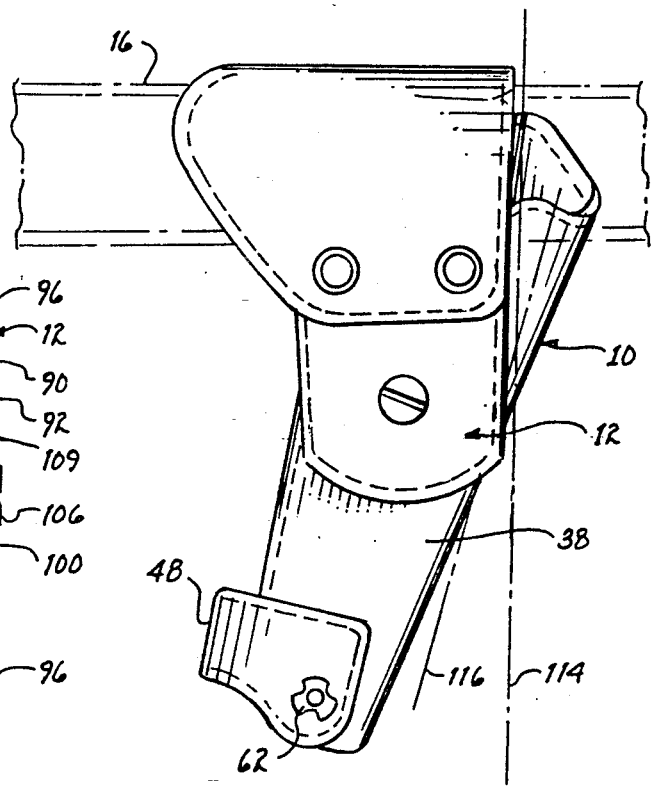
FIG. 4 is a side view illustrating adjustment of the vertical alignment variations of the holster with respect to a belt supported fender.
Figure 5:
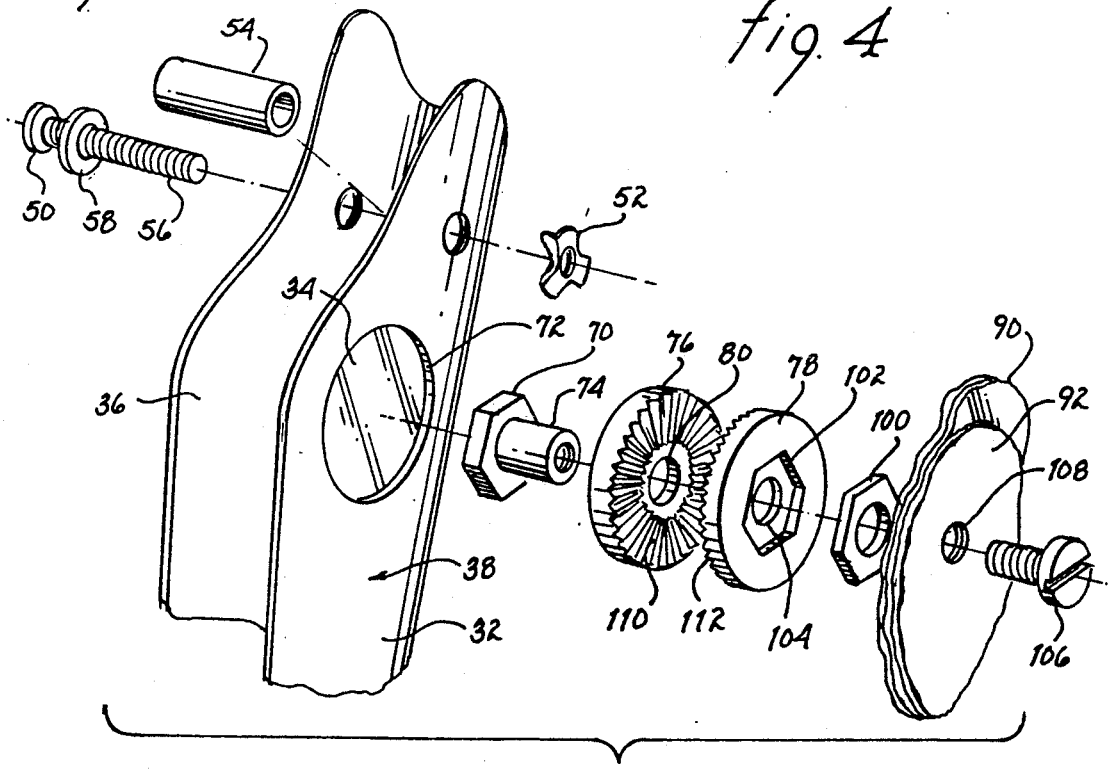
FIG. 5 is an exploded isometric view illustrating a ratchet mechanism for supporting the holster on the fender.
Figure 6:
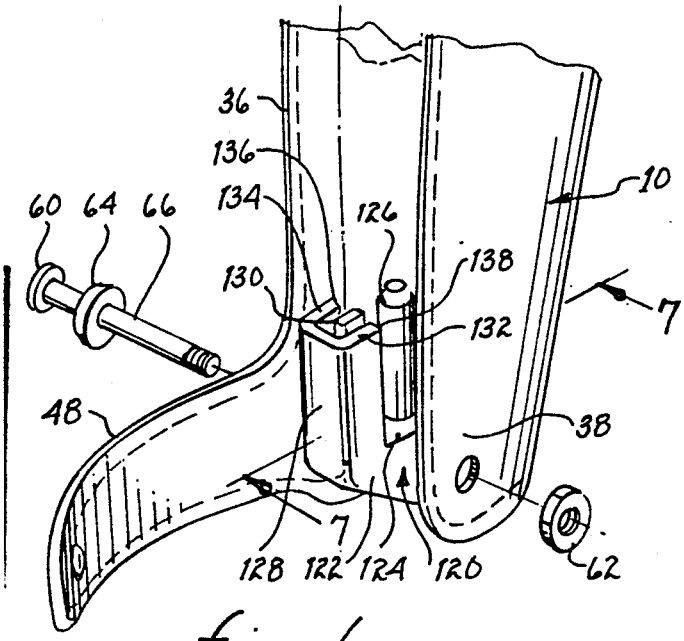
FIG. 6 is a partial view illustrating the muzzle supporting end of the holster.

The vertical alignment of holster 10 is adjustably retained and maintained by ratchet mechanism 26, as jointly illustrated in FIGS. 3, 4 and 5. A base or threaded nut 70 is attached or otherwise rigidly secured to metallic sheet 34 exposed in side 38 by a roundel 72 formed in laminate 32. The nut may include a threaded boss 74 extending therefrom for penetrably receiving and supporting opposed ratchets 76,78. Ratchet 76 nests within roundel 72 and includes an aperture 80 for receiving boss 74 and an indentation 82 encircling aperture 80, which indentation conforms in planform with nut 70 to receive the nut. Thereby, ratchet 76 can become non rotatably mounted upon boss 74 and holster 10. Fender 12 includes a metallic sheet 90 disposed between laminations 92,94, which laminations may be of leather or other material. The edges of the laminations are secured to one another by stitching 96, adhesives or a combination thereof. An apertured hexagonal or non circular washer 100 is welded or otherwise rigidly secured to metallic sheet 90. An indentation 102 is formed in ratchet 78, which indentation conforms in planform with that of washer 100. An aperture 104 in ratchet 78 penetrably receives, along with washer 100, a machine screw 106 extending through aperture 108 in the fender. A roundel 109 in lamination 94 receives ratchet 78. Thereby, ratchet 78 is non rotatably attached to fender 12 via washer 100.

Upon penetration of machine screw 106 through ratchets 78 and 76 and into threaded engagement with boss 74, the ratchets, and accompanying holster and fender, are drawn toward one another. The plurality of interfering means, such as radial teeth 110,112, formed in ratchet 76,78, respectively, preclude rotation of ratchet 76 relative to ratchet 78. Upon loosening of machine screw 106 to disengage ratchets 76,78 from one another, the ratchets may be repositioned relative to one another by rotating holster 10 relative to fender 12. Because of the multiplicity of radial teeth, incremental rotation can be effected to a degree of fineness necessary for a shooter to locate the vertical alignment of his holster at a position of choice. Upon inspection, it will become apparent that no amount of force exerted upon either the holster or the fender will reorient the alignment between the holster and the fender unless ratchets 76,78 are permitted to become disengaged from one another.

As functionally illustrated in FIG. 4, the vertical alignment of holster 10 may be modified. For example, the holster may be in alignment with a vertical line denoted by numeral 114, realigned to a line denoted by numeral 116 or further realigned to the position illustrated.

FIGS. 6, 7, 8 and 9 illustrate the muzzle retention mechanism 120 disposed within the lower end of holster 10. The muzzle mechanism includes a base 122 having a horizontal platform 124 from which a pin 126 extends. The pin has a diameter commensurate with the caliber of the handgun to be mounted in holster 10. A spacer 128 is formed as part of body 122 and extends upwardly from platform 124. The spacer includes a slot 130 for accommodating translation therein of the front sight of the handgun. Flanges 132,134, extending generally parallel with the longitudinal axis of pin 126, have slanted or canted edges 136,138, respectively, generally commensurate with the curvature of the exterior surface of the barrel proximate the muzzle; these edges serve in the manner of ramps for guiding the muzzle of the barrel into and out of the holster. Strap 48, including threaded socket 62 disposed therein, wraps around spacer 128 of mechanism 120 to provide rigidity to the lower end of the holster. Because of the disposition of the spacer between the muzzle and strap 48, the muzzle is not present and will not contact the strap and uneven or varying pressure and/or friction that would be exerted by strap 48 on the muzzle does not affect withdrawal of the muzzle of the handgun from the lower end of the holster.

Figure 9:
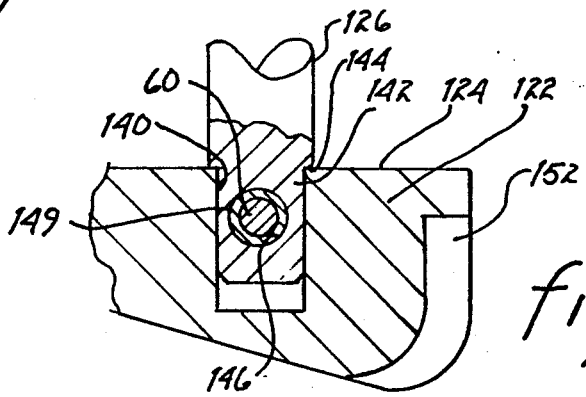
FIG. 9 illustrates the removably attached muzzle supporting pin and base therefor.

For manufacturing reasons and to permit a user to use holster 10 with handguns of different caliber, pin 126 is replaceable to match the handgun being used. A cylindrical cavity 140 extends into body 122 from platform 124 to receive shank 142 of pin 126. The diameter of shank 142 is the same for pins 126 of different diameter. The pin includes an annular shoulder 144 to rest upon platform 124 and a passageway 146 extending through the shank of the pin. Shank 66 of machine bolt 60 penetrably engages passageways 147,148 in base 122 and passageway 146 in the pin shank to lock the pin in place. It is apparent that upon removal of machine bolt 60, pin 126 may be readily replaced. As shown in FIG. 9, a spacer 149 may be disposed in passageways 146,147 and 148 to receive shank 66 of screw 60.

As described above, mechanism 120 is primarily secured within holster 10 by only machine screw 60. To stabilize the mechanism without depending upon the tightness to which the machine screw is threaded, a second supporting device is employed. This device is formed in the manner of a slot 150 formed central to and along the rear side and bottom of body 122. A metal screw 152 supported by a washer 154 penetrably engages the rear center at the lower bottom of holster 10 through a preformed passageway 156. The size of threaded shank 158 of screw 152 is greater in diameter than the width of slot 150. Accordingly, the threads will penetrably engage opposed sides of the slot. Upon such engagement, pivotal movement of mechanism 120 about an axis represented by machine screw 60 is precluded. It will also become apparent that the angular orientation of the axis of pin 126 may be modified forwardly and rearwardly by rotating mechanism 120 about machine screw 60 until pin 126 is aligned with the barrel of the handgun at a position of the handgun within the holster that is most comfortable and most useful to a shooter. Moreover, because screw 152 is readily disengageable from slot 150, adjustments in alignment of pin 126 may be readily made during trials and testing by the shooter.

Figure 7:
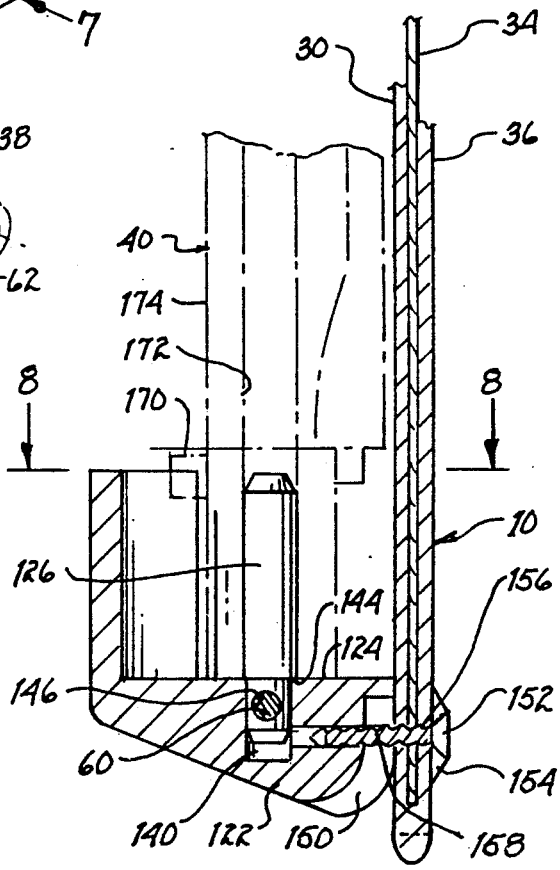
FIG. 7 i a cross sectional view taken along lines 7—7, as shown in FIG. 6.
Figure 8:
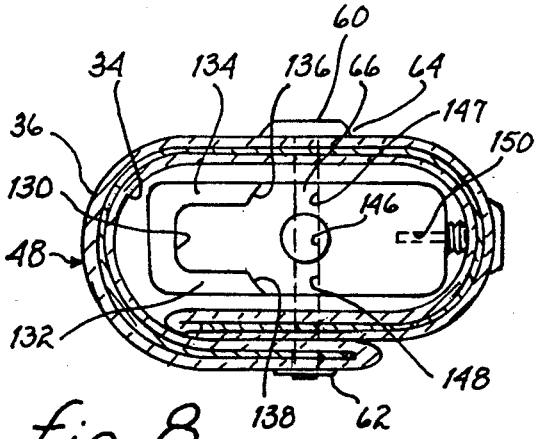
FIG. 8 is a cross sectional view taken along lines 8—8, as shown in FIG. 7.

As particularly illustrated in phantom lines in FIG. 7, sight 170 of handgun 40 rests within slot 130 of spacer 128 upon engagement of pin 126 with bore 172 at the muzzle of barrel 174. Platform 124, providing a planar surface, supports the muzzle. Pin 126, being selected to be dimensioned equivalent to bore 172, essentially precludes any lateral displacement of the muzzle. This restriction on any canting of the barrel serves a further function of retaining the barrel intermediate compressively gripping sides 36,38. That is, handgun 40 cannot be removed from within holster 10 without drawing the handgun up from mechanism 120 in alignment with pin 126. Only upon clearance of the muzzle with the pin can the handgun be tilted forwardly (laterally) out of gripping engagement with sides 36,38. Since the sides need only grip the handgun with sufficient force to prevent sliding movement of the handgun during a change in stance of the shooter, much less force is required than if the sides also had to grip the handgun sufficiently robustly to prevent pivotal movement of the handgun. Accordingly, the shooter needs to exert a relatively small amount of force to withdraw the handgun and yet have assurance that the handgun will not come out of the holster during a change in stance or other movement by the shooter.

In the above discussion, a suggestion might be presumed that the holster is limited to handguns other than revolvers. Such is not the case. By contouring edges 86,88 (see FIGS. 1 and 2) of sides 36,38, clearance for the cylinder of a revolver can be achieved. Thus, the sides will be capable of gripping the barrel of a revolver as readily as they grip the barrel of a clip fed hand gun.

While the principles of the invention have now been made clear in an illustrative embodiment, there will be immediately obvious to those skilled in the art many modifications of structure, arrangement, proportions, elements, materials and components used in the practice of the invention which are particularly adapted for specific environments and operating requirements without departing from those principles.

I claim:

1. Apparatus for supporting a handgun, said apparatus comprising in combination:

a) a holster for removably receiving the handgun;

b) a fender for supporting said holster;

c) means for pivotally attaching said holster to said fender, said attaching means including ratchet means for maintaining an angle of attachment between said holster and said fender and means for disengaging and reengaging said ratchet means to alter the angle of attachment;

d) said holster including rearwardly joined sides having forwardly oriented edges displaced from one another to permit exposure of a substantial part of the barrel of the handgun and means for urging said sides toward one another to grippingly engage the barrel of the handgun, said urging means including a metallic sheet and laminations disposed on opposed sides of said metallic sheet;

e) a base disposed at the lower end of said holster for supporting the muzzle resting thereagainst and including rigid pin means of a diameter not greater than the bore of the barrel extending from said base for penetrably engaging a segment of the bore at the muzzle of the handgun to prevent forward rotation of the handgun about the muzzle and past the edges of said sides;

f) means for realigning said pin means in a fore and aft plane relative to said holster and irrespective of the angular relationship between said holster and said fender; and g) a spacer extending from said base and including a slot for at least partially receiving the front sight of the handgun and for guiding the muzzle end of the barrel into and out of said holster.

2. The apparatus as set forth in claim 1 including means for replacing said pin.

3. The apparatus as set forth in claim 1 including a strap extending from one of said sides and about said spacer and means for attaching said strap to the other of said sides.

4. The apparatus as set forth in claim 1 including a cross member disposed at the upper end of said holster for interconnecting said sides.

5. The apparatus as set forth in claim 4 including a strap extending from one of said sides and about said spacer and means for attaching said strap to the other of said sides.

6. The apparatus as set forth in claim 4 wherein said crossmember includes means for supporting the trigger guard of the handgun.

7. The apparatus as set forth in claim 1 wherein said rearwardly joined sides define a U shape in cross section.

8. A fast draw holster for a handgun, said handgun having a muzzle end, said holster comprising in combination:

a) means for compressively gripping opposed sides of the barrel of the handgun;

b) a base disposed at the muzzle end of said holster;

c) pin means extending from said base means and of a diameter not greater than the bore of the handgun and extending into the muzzle of the barrel for requiring an initial movement of the handgun only in a direction away from said base means and for a distance equivalent to the extent of penetration of said pin means into the muzzle and along the longitudinal axis defined by the bore of the handgun to begin drawing the handgun;

d) means for adjusting the alignment of the longitudinal axis of the bore relative to said holster upon placement of the handgun within said holster; and e) means for accommodating lateral movement of the handgun to draw the handgun from between said gripping means and from within the holster after the initial longitudinal movement of the handgun necessary to clear said pin means from within said muzzle.

9. The apparatus as set forth in claim 8 wherein said base means includes means for supporting the muzzle of the handgun.

10. The holster as set forth in claim 8 including means for supporting the trigger guard of the handgun.

11. Apparatus for releasably retaining a handgun within a fast draw holster, said apparatus comprising in combination:

a) gripping means being U shaped in cross section and having opposed sides for urging a gripping force on opposed sides of the barrel of the handgun to restrain but not restrict the handgun against translatory movement along the longitudinal axis of the bore;

b) means interconnecting said opposed sides of said gripping means for modifying the gripping force urged by said gripping means;

c) cylindrical pin means disposed at the lower end of the holster for penetrably engaging the bore at the muzzle of the barrel to limit movement of the handgun to translation along the longitudinal axis of the bore for a distance equivalent to the length of said pin means, including means for realigning the axis of said pin means; and d) said opposed sides of said gripping means including spaced apart edges defining a lateral passage for the handgun out of the holster, said gripping means further including a bent U shaped metallic sheet and laminations disposed on said metallic sheet; whereby, said gripping means restrains translatory movement of the handgun along said pin means and said pin means restrains lateral movement of the handgun from within said holster.

12. The apparatus as set forth in claim 11 including means for guiding the muzzle of the handgun upon translatory movement of the handgun.

13. The apparatus as set forth in claim 11 wherein said pin means is configured to mate with the bore.

14. A fast draw holster having an open front and apparatus disposed at the end of the holster for engaging the muzzle of a handgun placed within the holster, said apparatus comprising in combination:

a) a base for supporting the muzzle;

b) means for securing the base to the end of the holster;

c) a pin extending from said base for penetrating the bore of the muzzle;

d) means for replacing said pin, said replacing means comprising a cylindrical cavity formed in said base, a shank extending from said pin for insertion into said cylindrical cavity, a passageway extending through said base and said shank and means insertable within said passageway for precluding withdrawal of said shank from within said cylindrical cavity; and e) a spacer extending from said base, said spacer including a slot for receiving at least a part of the front sight of the handgun and means for guiding the muzzle during withdrawal of the handgun from the holster.

15. The apparatus as set forth in claim 14 wherein the diameter of said pin is commensurate with the bore of the handgun.

16. The apparatus as set forth in claim 14 wherein said precluding means comprises said securing means.

17. A fast draw holster having an open front and apparatus disposed at the end of the holster for engaging the muzzle of a handgun placed within the holster, said apparatus comprising in combination:

a) a base for supporting the muzzle and for limiting movement of the muzzle toward the end of the holster;

b) means for securing the base to the end of the holster;

c) a pin extending from said base for penetrating the bore of the muzzle and for accommodating placement of the muzzle against said base upon holstering the handgun;

d) means for realigning said base relative to the holster to realign said pin;

e) a spacer extending from said base, said spacer including a slot for receiving at least a part of the front sight of the handgun and for permitting unimpeded translation of the front sight away from the end of the holster and means for guiding the muzzle during withdrawal of the handgun from the holster; and f) a strap extending across the open front of the holster, said strap having a width generally commensurate with the degree of extension of said pin from said base.

18. The apparatus as set forth in claim 17 including means for replacing said pin.

19. The apparatus as set forth in claim 17 wherein said guiding means comprises a ramp disposed on each side of said slot.

20. Apparatus for supporting a handgun, said apparatus comprising in combination:

a) a holster for receiving and supporting the handgun;

b) a base disposed upon one side of said holster;

c) a first coin shaped ratchet having a facing side and a rear side, a first plurality of radially aligned alternating ridges and grooves disposed on the facing side, and a countersink disposed in the rear side for engaging said base to prevent rotation of said first ratchet relative to said holster;

d) a fender for supporting said holster;

e) a non circular element disposed upon said fender;

f) a second coin shaped ratchet having a facing side and a rear side, a second plurality of radially aligned alternating ridges and grooves disposed on the facing side for interlocking with said first plurality of radially aligned ridges and grooves, an indentation disposed on the rear side for engaging said non circular element to prevent rotation of said second ratchet relative to said fender; and g) means for engaging the facing sides of said first and second ratchets to positionally fix the orientation of said holster with respect to said fender through engagement of said first plurality of radially aligned ridges and grooves with said second plurality of radially aligned ridges and grooves.

21. The apparatus as set forth in claim 20 wherein said drawing means comprises a threaded shank in engagement with a threaded receiver.

22. The apparatus as set forth in claim 20 wherein said base comprises a nut extending from said holster and wherein said countersink comprises a recess for receiving said nut.

23. The apparatus as set forth in claim 22 wherein said non circular element comprises a further nut extending from said fender and wherein said indentation comprises a recess for receiving said further nut.

24. The apparatus as set forth in claim 20 wherein said non circular element comprises a nut extending from said fender and wherein said indentation comprises a recess for receiving said nut.

* * * * *